US009508504B2

(12) United States Patent
Suzuki et al.

(10) Patent No.: US 9,508,504 B2
(45) Date of Patent: Nov. 29, 2016

(54) PRESSURE-SENSITIVE SWITCH, MANUFACTURING METHOD FOR SAME, TOUCH PANEL INCLUDING PRESSURE-SENSITIVE SWITCH, AND MANUFACTURING METHOD FOR TOUCH PANEL

(71) Applicant: Panasonic Intellectual Property Management Co., Ltd., Osaka (JP)

(72) Inventors: Takeshi Suzuki, Osaka (JP); Tetsuyoshi Ogura, Osaka (JP); Aki Yazawa, Hyogo (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 187 days.

(21) Appl. No.: 14/512,459

(22) Filed: Oct. 12, 2014

(65) Prior Publication Data

US 2015/0114814 A1 Apr. 30, 2015

(30) Foreign Application Priority Data

Oct. 30, 2013 (JP) ..... 2013-225711

(51) Int. Cl.

| | |
|---|---|
| ***H01H 9/26*** | (2006.01) |
| ***H01H 13/702*** | (2006.01) |
| ***H01H 13/88*** | (2006.01) |
| ***H01H 13/703*** | (2006.01) |
| ***H01H 13/79*** | (2006.01) |

(52) U.S. Cl.

CPC ..... *H01H 13/702* (2013.01); *H01H 13/703* (2013.01); *H01H 13/79* (2013.01); *H01H 13/88* (2013.01); *H01H 2201/036* (2013.01); *H01H 2203/02* (2013.01); *H01H 2209/004* (2013.01); *H01H 2209/082* (2013.01)

(58) Field of Classification Search

CPC ..... H01H 13/702; H01H 13/88; H01H 13/79
USPC ..... 200/512, 600; 338/47
See application file for complete search history.

(56) References Cited

U.S. PATENT DOCUMENTS

| | | | | |
|---|---|---|---|---|
| 3,830,991 | A * | 8/1974 | Durocher | H01H 3/141 200/86 R |
| 4,017,697 | A * | 4/1977 | Larson | H01H 13/702 200/5 A |
| 6,483,055 | B1 * | 11/2002 | Tanabe | H01H 3/141 200/512 |
| 7,034,808 | B2 * | 4/2006 | Sakata | G06F 3/045 345/173 |
| 7,112,755 | B2 * | 9/2006 | Kitano | G01L 1/20 200/17 R |
| 7,163,733 | B2 * | 1/2007 | Bourdelais | B32B 3/12 200/512 |
| 7,230,198 | B2 * | 6/2007 | Cok | G06F 3/045 200/512 |
| 8,310,465 | B2 * | 11/2012 | Iwasaki | G06F 3/045 345/174 |
| 8,624,869 | B2 * | 1/2014 | Onaka | G06F 3/045 200/512 |
| 2006/0131158 | A1 * | 6/2006 | Takiguchi | H01H 13/702 200/512 |
| 2008/0283380 | A1 | 11/2008 | Tanabe et al. | |

FOREIGN PATENT DOCUMENTS

| | | |
|---|---|---|
| JP | 2008-311208 | 12/2008 |

* cited by examiner

*Primary Examiner* — Kyung Lee
(74) *Attorney, Agent, or Firm* — Wenderoth, Lind & Ponack, L.L.P.

(57) ABSTRACT

A pressure-sensitive switch includes a first substrate, a conductive structure provided on the first substrate, and an electrode unit disposed to face the first substrate with the conductive structure interposed therebetween. The conductive structure includes an elastic component extending to protrude from the first substrate toward the electrode unit, and an electrode layer covering the elastic component.

16 Claims, 13 Drawing Sheets

PRESSURE-SENSITIVE SWITCH, MANUFACTURING METHOD FOR SAME, TOUCH PANEL INCLUDING PRESSURE-SENSITIVE SWITCH, AND MANUFACTURING METHOD FOR TOUCH PANEL

BACKGROUND

1. Technical Field

The present disclosure relates to a pressure-sensitive switch and a manufacturing method for the pressure-sensitive switch. The present disclosure further relates to a touch panel including the pressure-sensitive switch, and a manufacturing method for the touch panel.

2. Description of the Related Art

An increase in functionality and versatility of various electronic devices, such as smartphones and car navigators, has quickly been progressed in recent years. In such a situation, a pressure-sensitive switch, which is one of component elements of those electronic devices, is also demanded to be reliably operable. A pressure-sensitive switch of related art mainly includes, as illustrated in FIG. 11, a support substrate 2, a conductive structure provided on the support substrate, and a pressing substrate 5 including an electrode unit 4 and disposed above the conductive structure (see Japanese Unexamined Patent Application Publication No. 2008-311208). The electrode unit is connected to an electronic circuit of a device through lead wires, etc. The conductive structure includes a conductor layer and resin particles in sizes of several tens to several hundreds μm, which are dispersed in the conductor layer. The surface of the conductive structure has a rugged form defined by the resin particles dispersed in the conductor layer.

The pressure-sensitive switch establishes electrical connection when the pressing substrate is pressed and the electrode unit provided on the pressing substrate is brought into contact with the conductor layer having the rugged surface. In the pressure-sensitive switch, when the pressing substrate is further pressed, the resin particles in the conductive structure are deformed and a contact area between the electrode unit and the conductor layer is increased, whereby a resistance value is reduced. Thus, in the pressure-sensitive switch, the applied pressure is sensed from change of the resistance value.

SUMMARY

The present disclosure provides a pressure-sensitive switch, which can reduce variations in change of the resistance value and which can sense the applied pressure with high accuracy, and a manufacturing method for the pressure sensitive switch.

According to one aspect of the present disclosure, there is provided a pressure-sensitive switch including a first substrate, a conductive structure provided on the first substrate, and an electrode unit disposed to face the first substrate with the conductive structure interposed therebetween, wherein the conductive structure includes an elastic component extending to protrude from the first substrate toward the electrode unit, and an electrode layer covering the elastic component.

With the one aspect of the present disclosure, variations in change of a resistance value can be reduced, and the applied pressure can be sensed with high accuracy.

DETAILED DESCRIPTION (Finding as Basis of Present Disclosure)

Prior to explaining embodiments of the present disclosure, the points studied by the inventors are described.

The pressure-sensitive switch of related art senses the applied pressure from change of the resistance value. In the pressure-sensitive switch of related art, however, because the resin particles exist irregularly inside the conductive structure, shapes of the resin particles are not uniformly deformed when the pressing substrate is pressed. Moreover, it is difficult to perform control in such a manner that the shapes of the resin particles are uniformly deformed when the pressing substrate is pressed. Therefore, the resistance value tends to vary even when the pressing substrate is pressed by the same pressure. In addition, the resin particles gradually deteriorate with repeated pressing of the pressing substrate. The inventors have found the fact that sensitivity of the pressure-sensitive switch may degrade as a result of the above-discussed situation.

On the basis of the above-mentioned finding, the inventors have conceived inventions set forth in the following embodiments of the present disclosure.

Pressure-sensitive switches according to the present disclosure will be described below.

((Pressure-Sensitive Switches According to Present Disclosure))

A pressure-sensitive switch according to a first embodiment of the present disclosure will be first described.

First Embodiment of Present Disclosure

Figure 1:
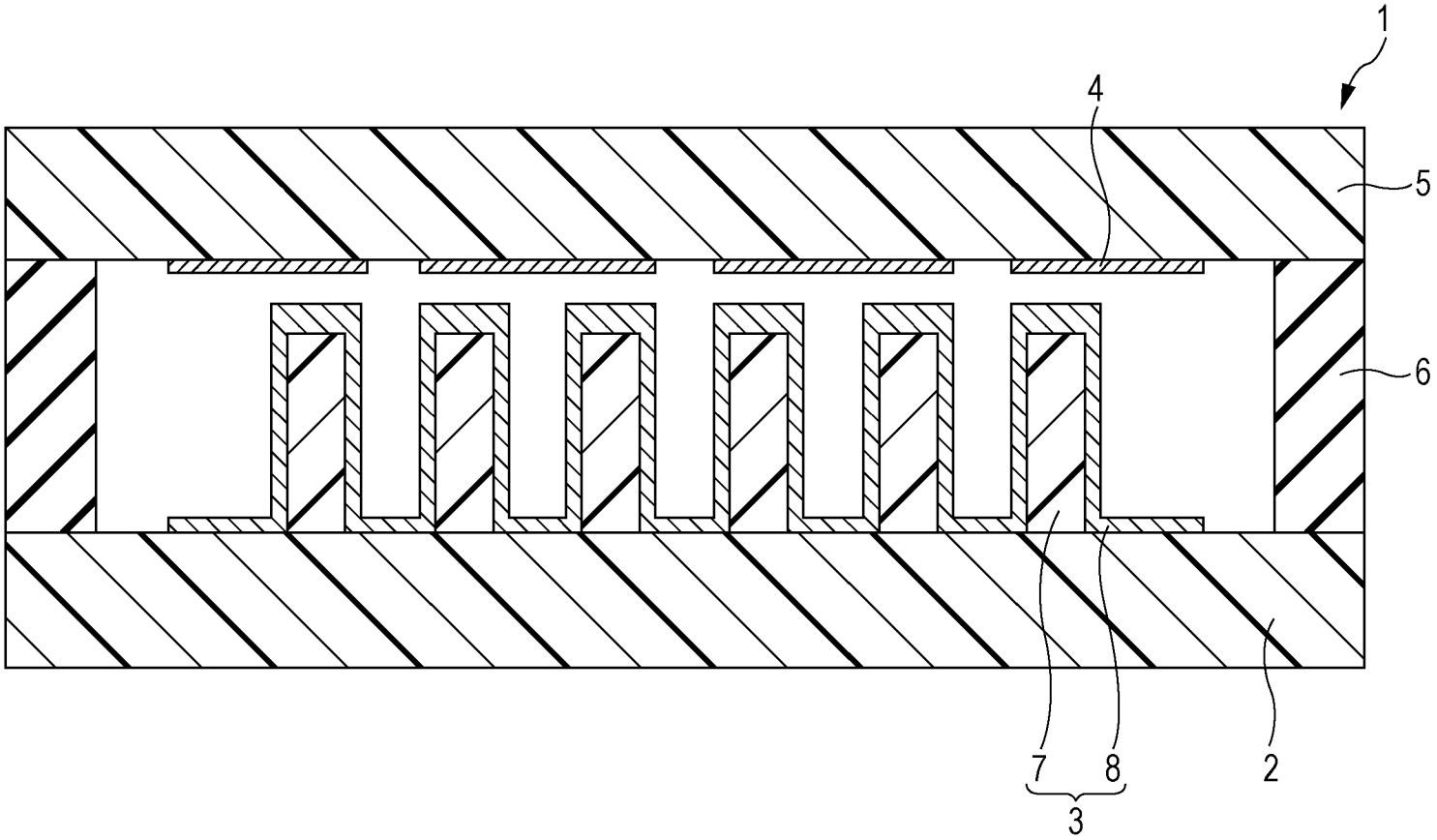
FIG. 1 is a schematic cross-sectional view of a pressure-sensitive switch according to a first embodiment of the present disclosure.

FIG. 1 is a schematic cross-sectional view of a pressure-sensitive switch 1 according to the first embodiment of the present disclosure. As illustrated in FIG. 1, the pressure-sensitive switch 1 includes a support substrate 2, a conductive structure 3 provided on the support substrate 2, and a pressing substrate 5 disposed to face the support substrate 2 with the conductive structure 3 interposed between them. The pressing substrate 5 is provided with a plurality of electrode units 4. More specifically, as illustrated in FIG. 1, the electrode units 4 are disposed on a lower surface of the pressing substrate 5. The pressing substrate 5 includes preferably at least two electrode units 4. The pressing substrate 5 is disposed to face the support substrate 2 with a spacer 6 interposed between them, the spacer 6 being disposed on a peripheral edge of the support substrate 2. The spacer 6 is made of insulating resin, such as a polyester resin or an epoxy resin. In the arrangement expressed by "with the conductive structure 3 interposed between them", it is enough that the conductive structure 3 exists between the support substrate 2 and the pressing substrate 5. Thus, the conductive structure 3 is not always required to be contacted with the support substrate 2 and the pressing substrate 5. Preferably, the support substrate 2 has flexibility. Here, the expression "the support substrate 2 has flexibility" implies that, when the pressing substrate 5 is pressed, the support substrate 2 is distorted into a convex shape protruding along a pressing direction. The support substrate 2 is made of, though not being particularly limited to, plastic such as polyethylene terephthalate, polycarbonate, or polyimide. Because the support substrate 2 has flexibility, the support substrate 2 can be disposed in a device having a three-dimensional structure as well. The pressing substrate 5 also has flexibility similarly to the support substrate 2. A thickness of the support substrate 2 is, e.g., 25 to 500 μm in consideration of durability and reduction in thickness of the pressure-sensitive switch.

The conductive structure 3 includes a plurality of elastic components 7 provided on the support substrate 2 and extending to protrude from the support substrate 2 substantially perpendicularly in a direction toward the electrode units 4, and an electrode layer 8 formed to cover the elastic components 7. In practice, the expression "extending to protrude from the support substrate 2 substantially perpendicularly in a direction toward the electrode units 4" implies that the elastic components 7 protrude from the support substrate 2 in the direction toward the electrode units 4 at angle in the range of, e.g., 60 to 90 degrees or 70 to 90 degrees. Preferably, at least two elastic components 7 are provided on the support substrate 2. The electrode units 4 are each disposed to face a portion of the continuously-formed electrode layer 8, the portion covering a top surface of the elastic component 7 and having a projecting shape. In other words, the electrode units 4 are disposed in opposing relation to the elastic components 7. The electrode layer 8 is continuously formed along not only respective surfaces of the elastic components 7 provided on the support substrate 2, i.e., respective protruding outline surfaces of the elastic components 7 provided on the support substrate 2, but also along a surface of the support substrate 2 exposed between the elastic components 7. Thus, the electrode layer 8 does not include a discontinuous portion along the surfaces of the elastic components 7 and the surface of the support substrate 2 exposed between the elastic components 7. As a result, the conductive structure 3 is formed as an integral structure of the elastic components 7 and the electrode layer 8.

Figure 8A:
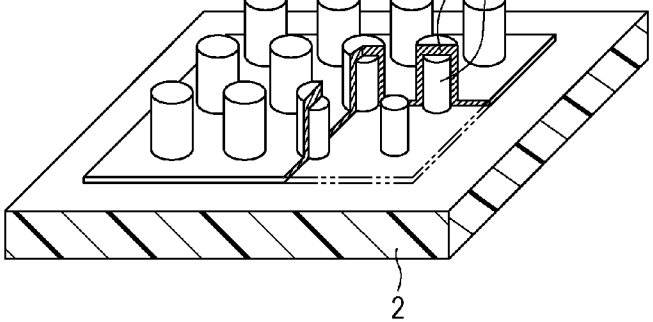
FIGS. 8A to 8D are each a schematic perspective view illustrating an elastic component that is a structural element of the pressure-sensitive switch according to the present disclosure.
Figure 8B:
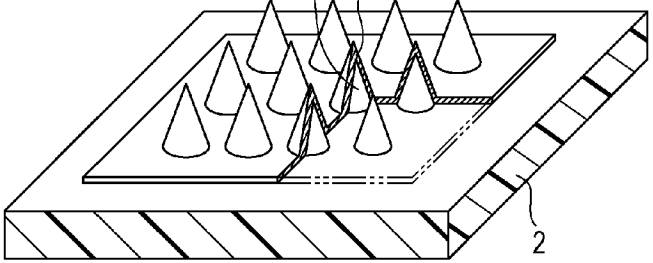

The expression "a plurality of elastic components 7 extending to protrude from the support substrate 2 substantially perpendicularly in a direction toward the electrode units 4, which are provided on the pressing substrate 5" implies a plurality of elastic components 7 each locally provided in a pillar shape on the support substrate 2, or a plurality of elastic components 7 each formed in a projecting shape on the support substrate 2. More specifically, the elastic components 7 are each provided on the support substrate 2 such that one end of the elastic component 7 is substantially fixed to the support substrate 2. The plural elastic components 7 are provided on the support substrate 2 in spaced relation from each other at intervals. Furthermore, as illustrated in FIG. 1, the elastic components 7 are provided on the support substrate 2 in a regular fashion. Stated in another way, the elastic components 7 are provided on the support substrate 2 in states of being the same in shape, material, and size. While the shape of the elastic component 7 is not limited to particular one, it preferably has a columnar structure as illustrated in FIG. 8A, or a conical structure as illustrated in FIG. 8B. The elastic component 7 is made of, though not being limited to, a urethane resin, a silicone based resin such as polydimethylpolysiloxane (PDMS), or a styrene resin, for example, each having an elastic property.

Figure 2:
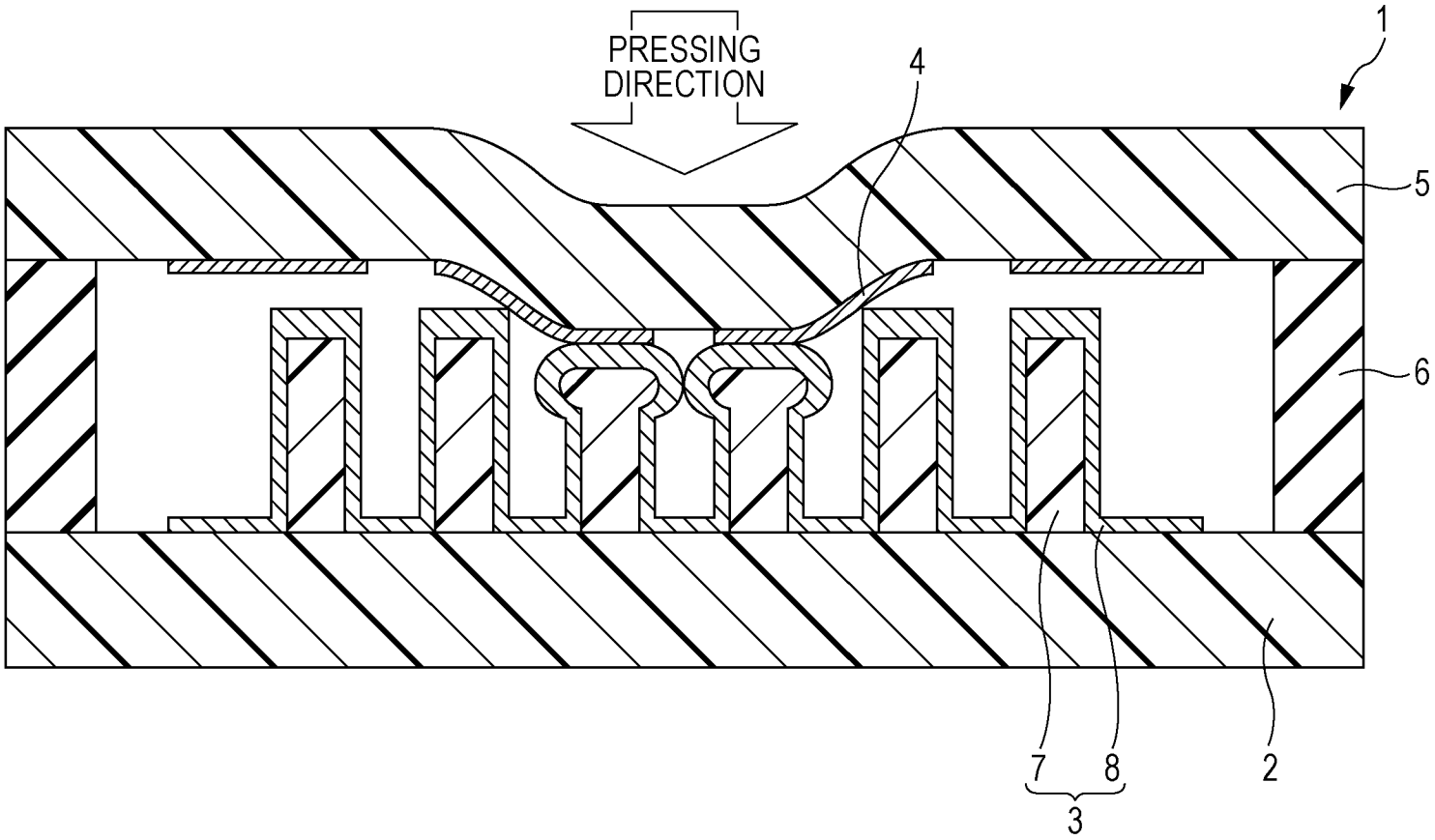
FIG. 2 is a schematic cross-sectional view illustrating a state where the pressure-sensitive switch according to the first embodiment of the present disclosure is pressed.

FIG. 2 is a schematic cross-sectional view illustrating a state where the pressure-sensitive switch according to the first embodiment of the present disclosure is pressed. As illustrated in FIG. 2, when the pressing substrate 5 is pressed toward the support substrate 2 that is disposed to face the pressing substrate 5, a pressed region of the pressing substrate 5 is distorted into a convex shape protruding toward the support substrate 2. This is because the pressing substrate 5 has flexibility similarly to the support substrate 2. With the distortion of the pressing substrate 5, the electrode unit(s) 4 provided on a surface of the pressing substrate 5 on the side opposite to the pressed surface of the pressing substrate 5 is also distorted toward the support substrate 2. More specifically, the electrode unit(s) 4 provided on the surface of the pressing substrate 5 on the side opposite to the actually pressed region of the pressed surface of the pressing substrate 5 is distorted into a convex shape protruding toward the support substrate 2. The distorted electrode unit(s) 4 is contacted with the electrode layer 8 covering the elastic component(s) 7 positioned to face the distorted electrode unit(s) 4, whereupon a current flows between the electrode unit(s) 4 and the electrode layer 8. Thus, the pressure-sensitive switch 1 according to the present disclosure is brought into an electrically connected state.

When a force acting to press the pressing substrate 5 toward the support substrate 2 is further increased, the shapes of those ones of the plural elastic components 7 provided on the support substrate 2, which ones correspond to the pressed region of the pressing substrate 5, can be uniformly deformed due to the elastic properties thereof. In other words, the elastic components 7 having the projecting shape, contacting the electrode units 4 and covered with the electrode layer 8 can be uniformly deformed so as to flex while their heights are reduced. The expression "uniform deformation of the elastic components 7" implies that, when the pressing substrate 5 is pressed under the same pressing conditions, the elastic components 7 in a portion contacting the electrode units 4 provided on the pressing substrate 5 are deformed into the same shape and size. Such uniform deformation is resulted from the fact that, as described above, the elastic components 7 having the same shape and size are formed of, e.g., a urethane resin, a silicone based resin, or a styrene resin, and have the same elastic property. When the elastic components 7 are deformed, the electrode layer 8 formed along the protruding outlines of the elastic components 7 is also uniformly deformed together with the elastic components 7 at the same time. With that deformation of the electrode layer 8, a contact area between the electrode unit(s) 4 and the electrode layer 8 can be uniformly increased.

Figure 5:
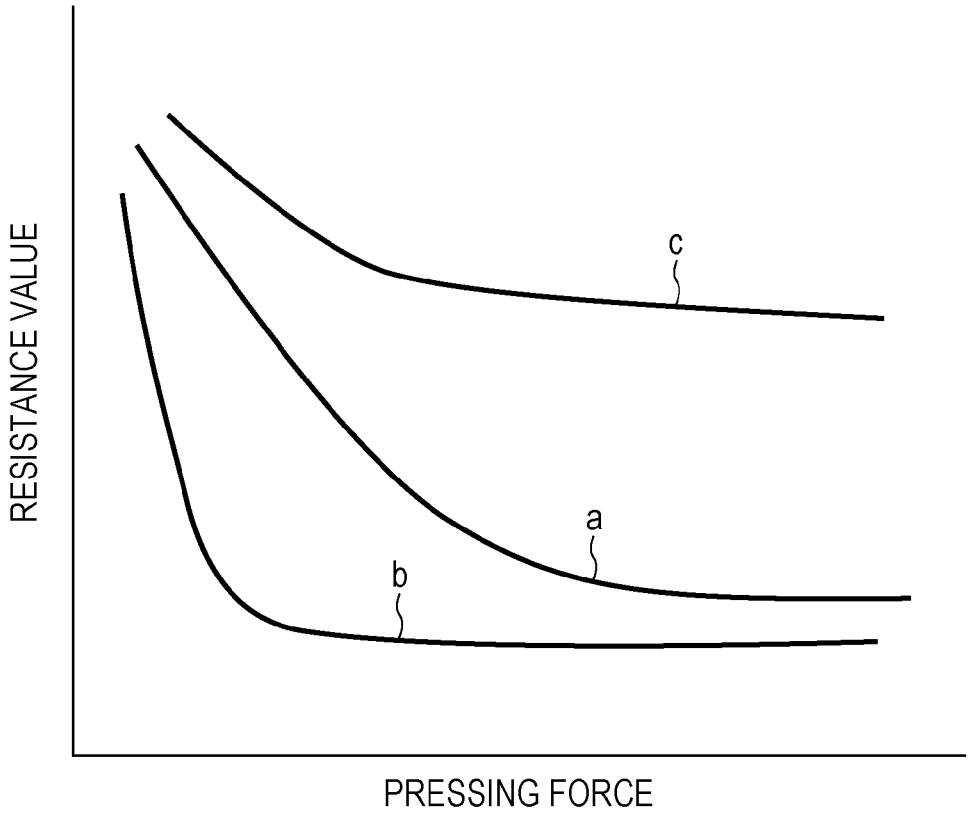
FIG. 5 is a plot of a resistance characteristic in the pressure-sensitive switch according to the first embodiment of the present disclosure.

FIG. 5 is a plot of a resistance characteristic in the pressure-sensitive switch according to the first embodiment of the present disclosure. The plot of the resistance characteristic represents change of a resistance value between the electrode unit(s) 4 and the electrode layer 8 with respect to the pressing force applied through the pressing substrate 5. As seen from FIG. 5, the resistance value between the electrode unit(s) 4 and the electrode layer 8 reduces continuously as the pressing force applied through the pressing substrate 5 increases. Such continuous reduction of the resistance value can be obtained with the above-mentioned feature that the contact area between and the electrode unit(s) 4 and the electrode layer 8 can be uniformly increased. Thus, since the resistance value between the electrode unit(s) 4 and the electrode layer 8 is continuously reduced, the pressing force applied through the pressing substrate 5 can be sensed with high accuracy. In other words, a value of the pressing force applied through the pressing substrate 5 can be calculated with high accuracy from an amount of continuous reduction of the resistance value between the electrode unit(s) 4 and the electrode layer 8.

As described above, the elastic components 7 are each provided on the support substrate 2 such that one end of the elastic component 7 is substantially fixed to the support substrate 2. Therefore, even when the pressing substrate 5 is pressed repeatedly, shear forces are less apt to act between the elastic component 7 and the electrode layer 8. Thus, deterioration of the elastic component 7 can be suppressed. Furthermore, since the elastic components 7 are each provided on the support substrate 2 in a state having a predetermined shape, such as a columnar or conical structure, the pressure applied to the elastic components 7 upon pressing of the pressing substrate 5 can be made uniform. It is hence possible to sense the pressing force applied through the pressing substrate 5 with high accuracy in a continued way.

Figure 6:
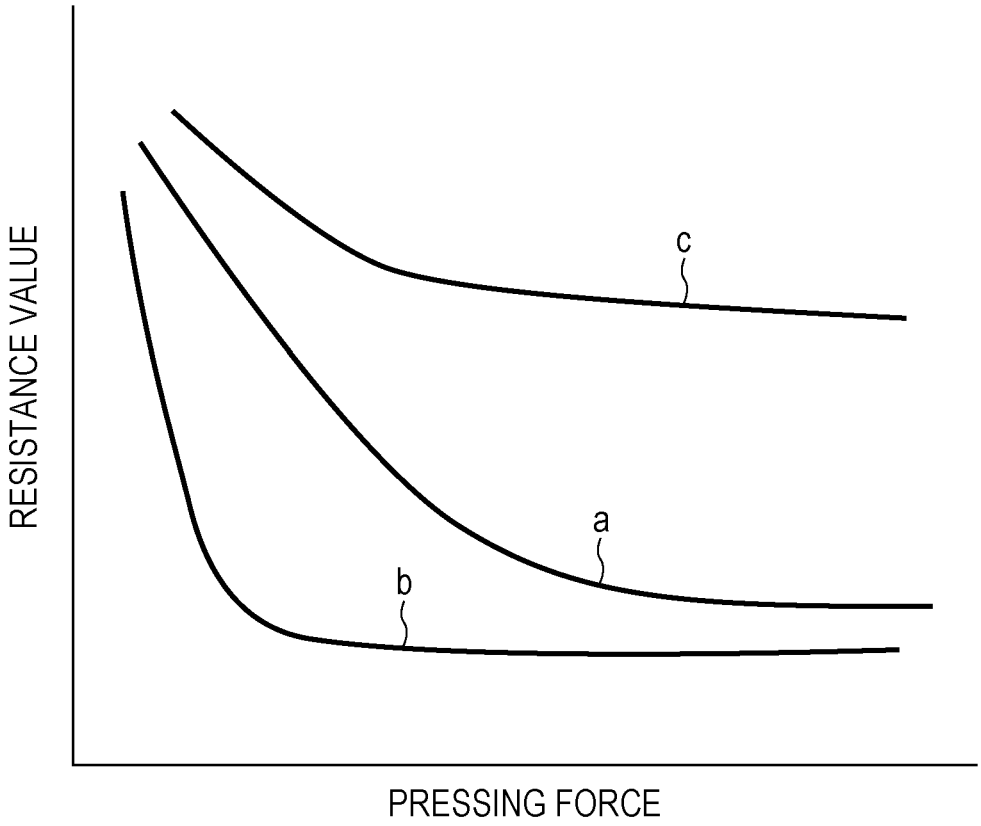
FIG. 6 is a plot of resistance characteristics in the pressure-sensitive switch according to the first embodiment of the present disclosure.

The elastic modulus of the elastic component 7 is set to, e.g., about 600 to 1500 kgf/cm$^2$ such that the elastic component 7 is avoided from being easily deformed by a small pressing force and an abrupt increase in the contact area between each electrode unit 4 and the electrode layer 8 is suppressed. FIG. 6 is a plot of resistance characteristics in the pressure-sensitive switch according to the first embodiment of the present disclosure when the elastic components 7 having different elastic properties are used. The plot of the resistance characteristics represents respective changes of the resistance value between the electrode unit(s) 4 and the electrode layer 8 with respect to the pressing force applied through the pressing substrate 5 when the elastic components 7 having different elastic properties are used. A curve b represents change of the resistance value between the electrode unit(s) 4 and the electrode layer 8 with respect to the pressing force applied through the pressing substrate 5 when the elastic component 7 having the elastic modulus of less than about 600 kgf/cm$^2$ is used. A curve c represents change of the resistance value between the electrode unit(s) 4 and the electrode layer 8 with respect to the pressing force applied through the pressing substrate 5 when the elastic component 7 having the elastic modulus of more than about 1500 kgf/cm$^2$ is used. In the case of the curve b, even when the pressing force applied through the pressing substrate 5 is relatively small, the contact area between the electrode layer 8 and the electrode unit 4 is abruptly increased because the elastic component 7 is easily deformed. Thus, it is difficult to sense the pressing force applied through the pressing substrate 5 with high accuracy for the reason that the resistance value is greatly changed even by a small pressing force. In the case of the curve c, even when the pressing force applied through the pressing substrate 5 is relatively large, the resistance value between the electrode unit(s) 4 and the electrode layer 8 is hardly changed because the elastic component 7 is hard to deform and the contact area between the electrode layer 8 and the electrode unit 4 is hardly changed. Thus, it is also difficult to sense the pressing force applied through the pressing substrate 5 with high accuracy. On the other hand, in the case of a curve a, when the pressing force is applied in the above-mentioned range, the contact area between the electrode layer 8 and the electrode unit 4 is gradually increased and the resistance value is gently reduced. Thus, the pressing force applied through the pressing substrate 5 can be sensed with high accuracy. A surface resistance value of the electrode layer 8 is, for example, 50 kΩ/sq. to 5 MΩ/sq. A surface resistance value of the electrode unit 4 is, for example, 0.5 kΩ/sq. to 30 kΩ/sq. If the resistance values of the electrode layer 8 and the electrode unit 4 are too small, the resistance value between the electrode layer 8 and the electrode unit(s) 4 is excessively reduced even when the pressing force applied through the pressing substrate 5 is small. On the other hand, if the resistance values of the electrode layer 8 and the electrode unit 4 are too large, the resistance value between the electrode layer 8 and the electrode unit(s) 4 is hardly reduced even when the pressing force applied through the pressing substrate 5 is increased. Accordingly, the resistance values of the electrode layer 8 and the electrode unit 4 are preferably held in the above-described ranges. When the electrode layer 8 and the electrode unit 4 are formed by coating ink as described later in connection with a manufacturing method for the pressure-sensitive switch according to the present disclosure, their resistance values can be controlled by properly adjusting the concentration and shapes of conductive particles contained in the ink. When the electrode layer 8 and the electrode unit 4 are formed by plating, their resistance values can be controlled by adjusting the composition, concentration, temperature, etc. of a plating solution so as to change, e.g., the density of a plated film.

Figure 3:
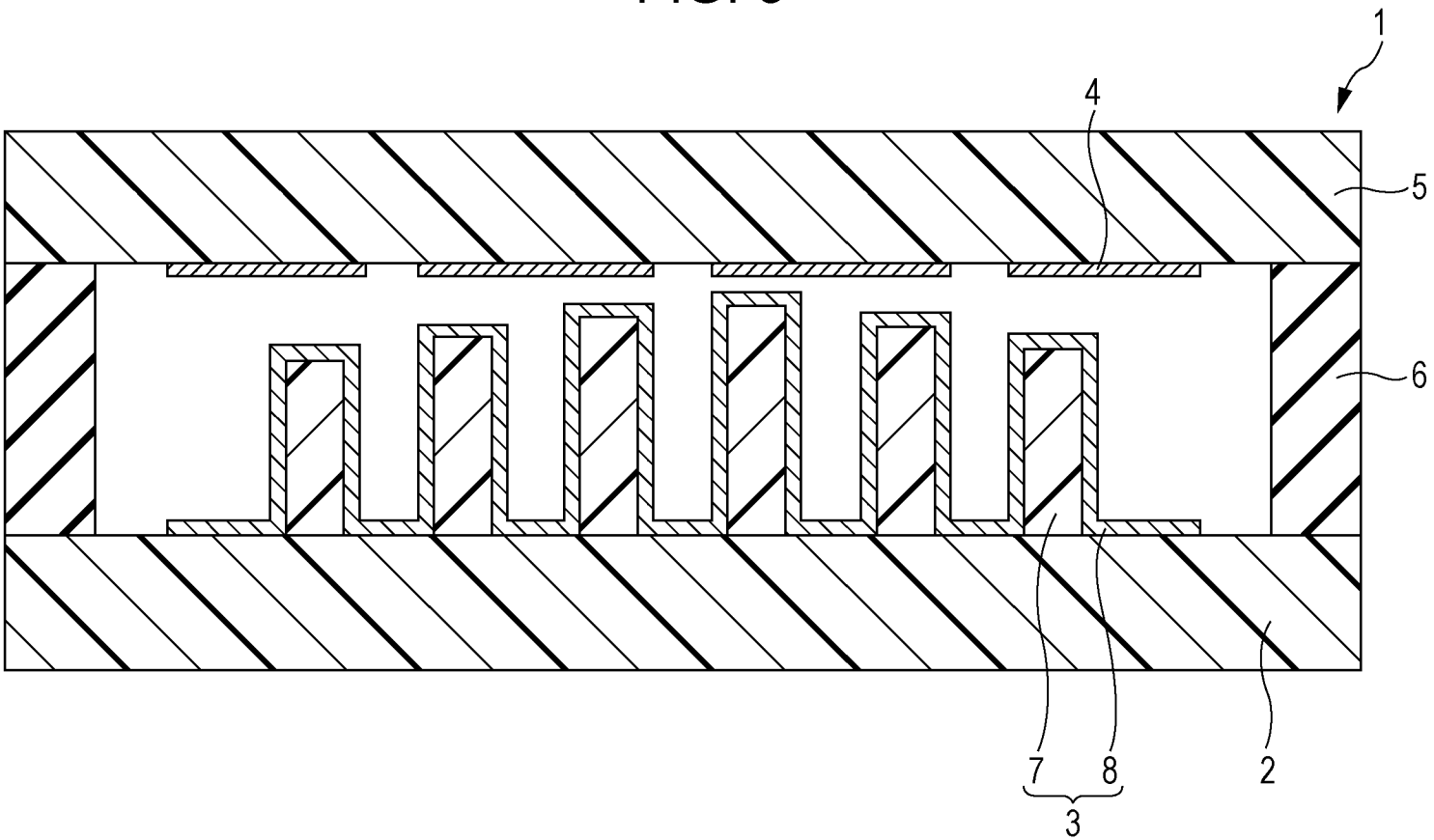
FIG. 3 is a schematic cross-sectional view illustrating a plurality of elastic components having different heights, which are structural elements of the pressure-sensitive switch according to the first embodiment of the present disclosure.
Figure 4:
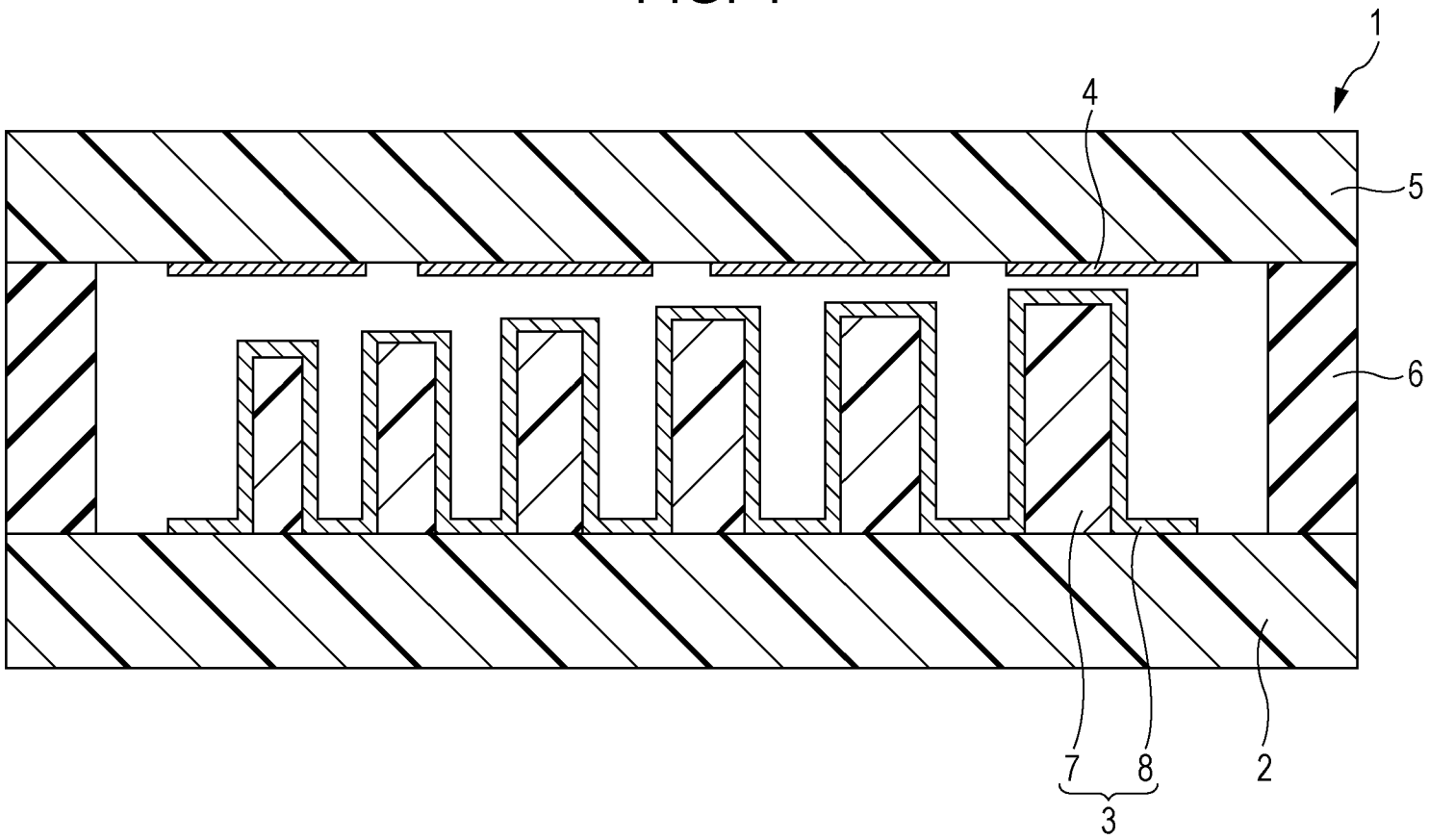
FIG. 4 is a schematic cross-sectional view illustrating an arrangement that heights of the plural elastic components, which are the structural elements of the pressure-sensitive switch according to the first embodiment of the present disclosure, correspond in relative magnitude to projection cross-sectional areas of the plural elastic components.

The individual elastic components 7 preferably have different heights, as illustrated in FIG. 3. However, the heights of the elastic components 7 are not needed to be different from one another. It is just required that at least one of the elastic components 7 has a different height from the height of the other elastic components 7. By properly controlling the heights of the elastic components 7 in advance, change of the contact area between the electrode unit(s) 4 and the electrode layer 8 can be moderated. Therefore, change of the resistance value between the electrode unit(s) 4 and the electrode layer 8 can be moderated. Hence the pressing force applied through the pressing substrate 5 can be sensed with high accuracy. Preferably, the heights of the elastic components 7 are different from one another. With such a feature, change of the contact area between the electrode unit(s) 4 and the electrode layer 8 can be made more moderate. It is hence possible to sense the pressing force applied through the pressing substrate 5 with higher accuracy. Furthermore, as illustrated in FIG. 4, the heights of the plural elastic components 7 preferably correspond in relative magnitude to projection cross-sectional areas of the plural elastic components 7. In more detail, of at least two elastic components 7, the relatively high elastic component 7 preferably has a relatively large projection cross-sectional area. Of at least two elastic components 7, the relatively low elastic component 7 preferably has a relatively small projection cross-sectional area. The projection cross-sectional area of the elastic component 7 is easier to control than the height of the elastic component 7. Thus, the change of the resistance value between the electrode unit(s) 4 and the electrode layer 8 can be moderated, and the pressing force applied through the pressing substrate 5 can be sensed with higher accuracy.

The elastic components 7 are each more preferably provided in the conical structure on the support substrate 2. When the elastic component 7 is of the conical structure, the contact area between the electrode unit 4 and the electrode layer 8 can be easily increased even with the magnitude of the pressing force applied through the pressing substrate 5 being small. Therefore, the resistance value between the electrode unit(s) 4 and the electrode layer 8 is can be changed even with the magnitude of the pressing force applied through the pressing substrate 5 being small. Hence the pressing force applied through the pressing substrate 5 can be sensed with high accuracy even when the magnitude of the pressing force applied through the pressing substrate 5 is small. In addition, each elastic component 7 preferably includes a regularly rugged region in its surface. With the elastic component 7 including the regularly rugged region in its surface, the electrode layer 8 formed along the protruding outline of the elastic component 7 also includes a regularly rugged region in its surface. Therefore, the change of the contact area between the electrode unit(s) 4 and the electrode layer 8 including the regular rugged region, caused by the pressing through the pressing substrate 5, can be more finely controlled. Thus, the resistance value between the electrode unit(s) 4 and the electrode layer 8 including the regularly rugged region can be more finely changed. It is hence possible to sense the pressing force applied through the pressing substrate 5 with higher accuracy.

Figure 7A:
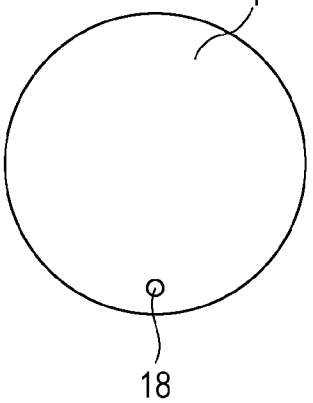
FIGS. 7A to 7E are each a schematic plan view of an electrode unit that is a structural element of the pressure-sensitive switch according to the first embodiment of the present disclosure.
Figure 7B:
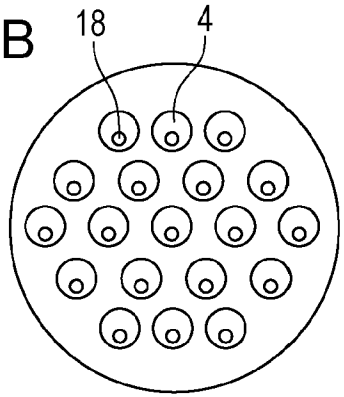

FIGS. 7A to 7E are each a schematic plan view illustrating a shape of the electrode unit 4 that is a structural element of the pressure-sensitive switch 1 according to the first embodiment of the present disclosure. In one example, as illustrated in FIG. 7A, the electrode unit 4 may be formed over the entire surface of the pressing substrate 5. An electrical output unit 18 is provided in the electrode unit 4. However, the electrode unit 4 is not limited to that example, and it may be practiced in other forms. In another example, the plural electrode units 4 may be formed in a regular array (FIG. 7B). In such a case, the electrical output unit 18 is provided for each of the electrode units 4. With that example, when the contact area between the electrode unit 4 and the electrode layer 8 is changed upon pressing, a pressed position in the plane direction can also be concurrently detected in addition to the pressing force by reading changes of resistance values between the individual electrode units 4 and the electrode layer 8. Moreover, the pressed position in the plane direction can also be detected in addition to the pressing force by reading changes of resistance values among the individual electrode units 4 instead of the changes of the resistance values between the individual electrode units 4 and the electrode layer 8.

Figure 7C:
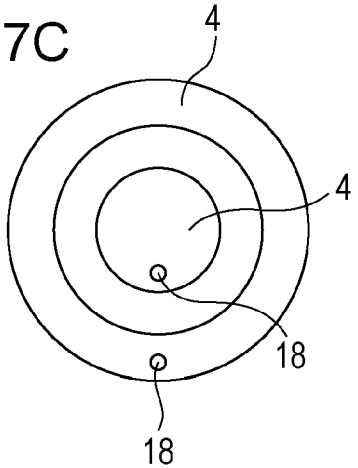
Figure 7D:
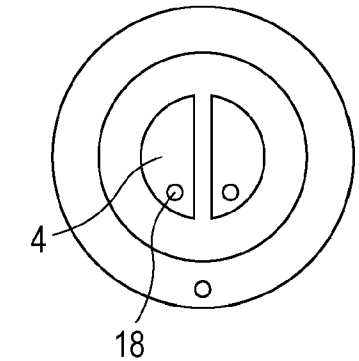
Figure 7E:
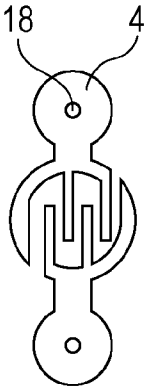
Figure 7E:
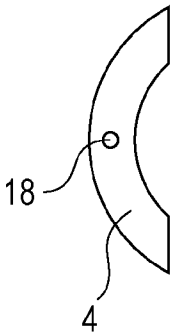

When reading the changes of the resistance values between the individual electrode units 4, a local contact failure between the electrode unit 4 and the electrode layer 8 can be compensated for by forming an electrode pattern, which includes a contact placed at the circumference and a contact placed at the center, as illustrated in FIGS. 7C to 7E. Thus, the changes of the resistance values can be stably read. In FIG. 7C, the contact placed at the center has a substantially circular shape, and the contact placed at the circumference is formed in a substantially ring-like or U-like shape around the contact placed at the center. In FIG. 7D, two substantially semicircular contacts placed at the center are disposed inside the contact placed at the circumference. Such an arrangement can output two resistance values between the contact placed at the circumference and one contact placed at the center and between the contact placed at the circumference and the other contact placed at the center. Furthermore, as illustrated in FIG. 7E, two contacts placed at the center may be disposed in forms of combs meshing with each other inside two substantially arc-shaped contacts placed at the circumference. With such an arrangement, stable change of the resistance value can be obtained even when the pressing substrate 5 and the support substrate 2 are slightly deviated from each other. Also in the examples illustrated in FIGS. 7C to 7E, the electrical output unit 18 is provided in each of the electrode units 4.

Second Embodiment According to Present Disclosure

The pressure-sensitive switch 1 according to the present disclosure can be practiced as not only the first embodiment described above, but also as a second embodiment described below. A pressure-sensitive switch 1 according to the second embodiment of the present disclosure will be described below with reference to FIGS. 8C and 8D.

Figure 8C:
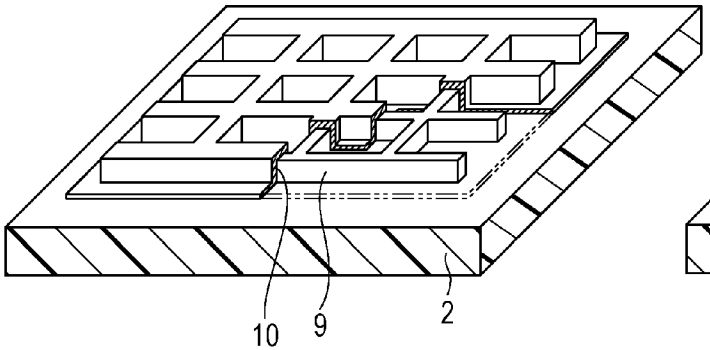
Figure 8D:
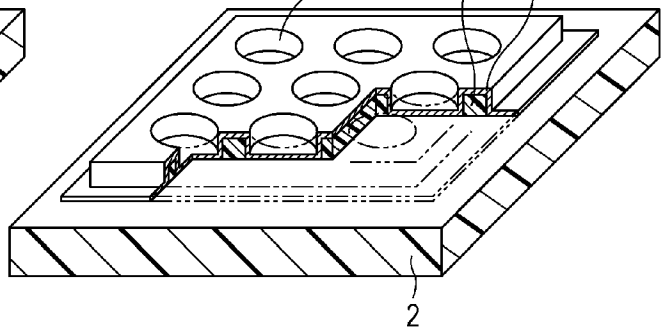

The pressure-sensitive switch 1 according to the second embodiment of the present disclosure includes a support substrate 2, a conductive structure 3 provided on the support substrate 2, and a pressing substrate 5 disposed above the conductive structure 3. The conductive structure 3 includes an elastic component 9 protruding in an entirely continuous form from the support substrate 2, and an electrode layer 10 formed to cover the elastic component 9. The elastic component 9 protruding in an entirely continuous form from the support substrate 2 may have a structure that the elastic component 9 is formed in a grid-like manner on the support substrate 2 as illustrated in FIG. 8C, or that the elastic component 9 including holes 11 is formed on the support substrate 2 as illustrated in FIG. 8D. However, the elastic component 9 is not limited to the above-mentioned structures because the elastic component 9 in this embodiment is just required to protrude in an entirely continuous form from the support substrate 2. In a broad sense, the elastic component 9 including the holes 11 formed as illustrated in FIG. 8D can also be regarded as an example in which the elastic component 9 is provided in a grid-like manner on the support substrate 2. The elastic component 9 is made of, though not being limited to, a urethane resin, a silicone based resin such as polydimethylpolysiloxane (PDMS), or a styrene resin, for example, each having an elastic property. When the pressing substrate 5 is pressed toward the support substrate 2 that is disposed to face the pressing substrate 5, a pressed region of the pressing substrate 5 is distorted into a convex shape protruding toward the support substrate 2. With the distortion of the pressing substrate 5, the electrode unit(s) provided on a surface of the pressing substrate 5 on the side opposite to the pressed surface of the pressing substrate 5 is also distorted toward the support substrate 2. The distorted electrode unit is directly contacted with the electrode layer 10 covering the surface of the elastic component 9, whereupon a current flows between the electrode unit and the electrode layer 10. Thus, the pressure-sensitive switch 1 according to this embodiment of the present disclosure is brought into an electrically connected state.

When the elastic component 9 is provided in the grid-like manner as illustrated in FIG. 8C, the electrode layer 10 is continuously formed to cover not only the elastic component 9 provided in a grid-like manner on the support substrate 2, but also portions of the support substrate 2, which are exposed from the grid-like elastic component 9. When the elastic component 9 including the holes 11 is provided on the support substrate 2 as illustrated in FIG. 8D, the electrode layer 10 is continuously formed to cover not only the elastic component 9 including the holes 11 and provided on the support substrate 2, but also portions of the support substrate 2, which are exposed through the holes 11. Thus, the conductive structure 3 is formed as an integral structure of the elastic component 9 and the electrode layer 8.

The pressing substrate 5 is provided with the electrode unit disposed to face the electrode layer 10 that is continuously formed over the entire elastic component 9. With such an arrangement, even when the pressing substrate 5 is pressed repeatedly, pressure applied to a portion of the continuously-formed elastic component 9 covered with the electrode layer 10, the portion corresponding to the pressed region, can be distributed to the entire elastic component 9. Accordingly, deterioration of the elastic component 9 can be suppressed. It is hence possible to sense the pressing force applied through the pressing substrate 5 with high accuracy in a continued way.

In the case of the elastic component 9 provided on the support substrate 2 in the grid-like manner or in a state having the holes 11, when a force pressing the pressing substrate 5 toward the support substrate 2 is increased, the portion of the continuously-formed elastic component 9 covered with the electrode layer 10, which portion corresponds to the pressed region, can be uniformly deformed due to the elastic property thereof. In other words, the portion of the elastic component 9 covered with the electrode layer 10, the portion corresponding to the pressed region and contacting the electrode unit, can be uniformly deformed so as to flex while its height is reduced. With the uniform deformation of the elastic component 9, a contact area between the electrode unit and the electrode layer 10 contacting the electrode unit can be uniformly increased. The expression "uniform deformation of the elastic component 9" implies that, when the pressing substrate 5 is pressed under the same pressing conditions, the elastic component 9 is deformed into the same shape. The height of a portion of the elastic component 9 may be different from that of the other portion, though not being particularly limited to such a case.

Because the elastic component 9 is provided in a continuous form entirely protruding from the support substrate 2, the electrode unit disposed to face the elastic component 9 is preferably formed over the entire surface of the pressing substrate 5. However, the electrode unit is not limited to such a configuration, and it may be provided plural. In that case, individual electrode units are disposed to face the electrode layer 10 covering the elastic component 9. Stated in another way, the electrode units are each disposed to face the elastic component 9. When the electrode unit is provided plural, the pressing force and the pressed position can be detected from changes of resistance values between the electrode layer 10 and the individual electrode units. Moreover, when the electrode unit is provided plural, the pressing force and the pressed position can also be detected from changes of resistance values among the individual electrode units.

In any of the above-described embodiments, the structural elements of the pressure-sensitive switch 1 according to the present disclosure, i.e., the support substrate 2, the elastic components 7 and 9, the electrode layers 8 and 10, the electrode unit 4, are preferably transparent in the visible region. To ensure the transparency, the structural elements of the pressure-sensitive switch 1 according to the present disclosure preferably have the following features. The support substrate 2 is preferably made of, e.g., polyethylene terephthalate or polycarbonate. The elastic components 7 and 9 are each preferably made of a urethane resin, a silicone based resin, or a styrene resin, which is mixed with an acrylic resin such as polymethacrylic acid methyl. A styrene based polymer alloy may be used instead. The electrode layers 8 and 10 and the electrode unit 4 are each preferably made of a transparent semiconductor material, such as $In_2O_3$ or ZnO. Alternatively, the electrode layer 8 may be formed by continuously coating particles, which are made of, e.g., Au, Ag, Cu or C and have nano wire shapes with diameters of several tens nm, over the elastic component 7 and the exposed portions of the support substrate 2. The electrode layer 10 may be formed as a pattern of grids in size of about several tens μm, which are made of, e.g., Ag or Cu and which are defined by lines having widths of several hundreds nm to several hundreds μm. As a result, visibility of a device, e.g., a touch panel, including the pressure-sensitive switch 1 according to the present disclosure, can be further improved when a user looks at the device. In other words, user-side convenience of the device can be further improved.

Figure 10:
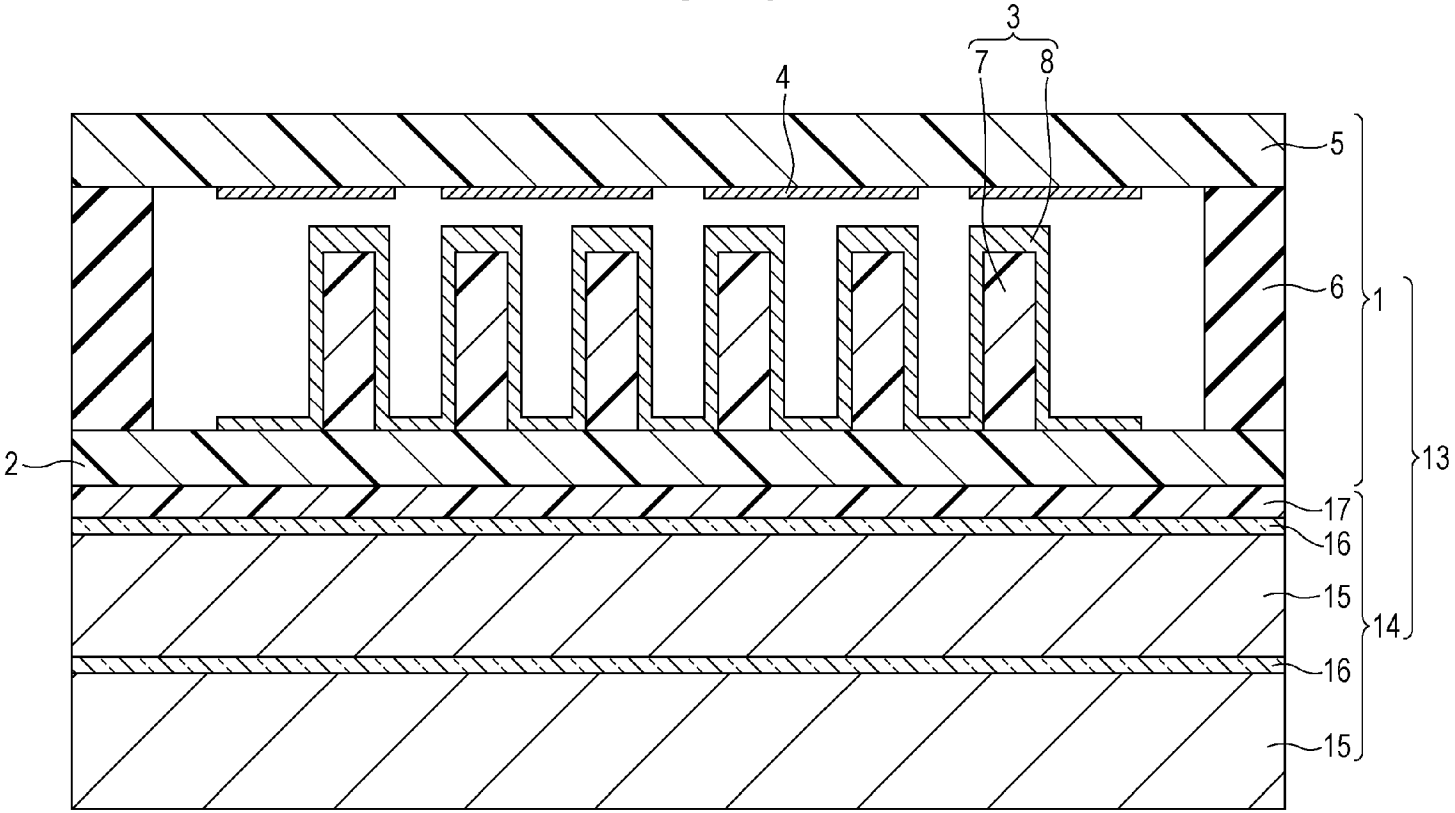
FIG. 10 is a schematic cross-sectional view of a touch panel including the pressure-sensitive switch according to the present disclosure.
Figure 11:
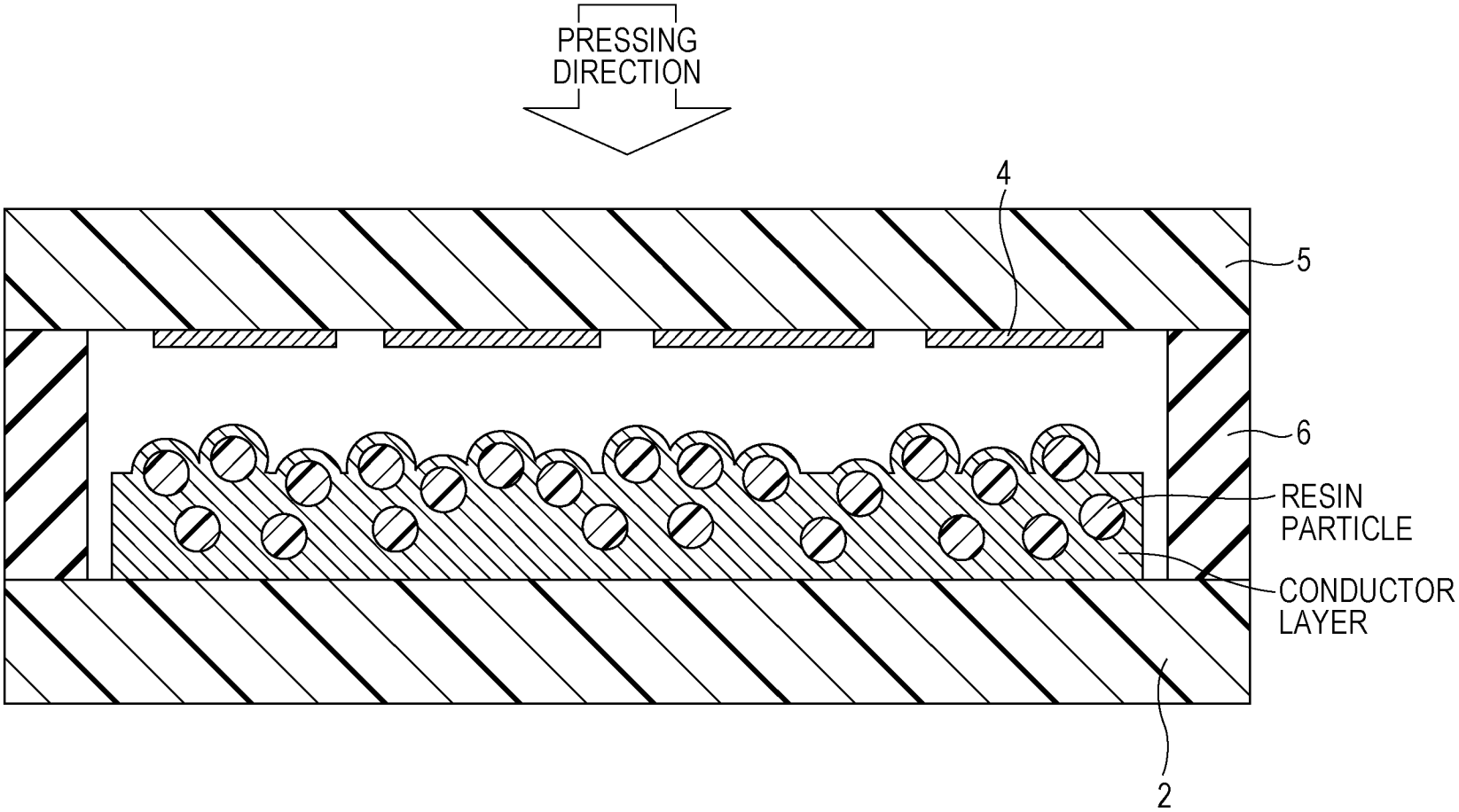
FIG. 11 is a schematic cross-sectional view of a pressure-sensitive switch of related art.

FIG. 10 is a schematic cross-sectional view of a touch panel 13 including the pressure-sensitive switch 1 according to the present disclosure. As illustrated in FIG. 10, the touch panel 13 including the pressure-sensitive switch 1 according to the present disclosure is constituted by a sensor 14 that detects only a touch location in the plane direction, and the pressure-sensitive switch 1 according to the present disclosure, which is disposed on the sensor 14 with a cover film 17 interposed between them. The sensor 14 is a composite structure in which two structures, each including a substrate 15 and a transparent conductive film 16 disposed on the substrate 15, are stacked one above the other in the pressing direction. The touch location in the plane direction is detected by the electrostatic capacitive method, for example. Thus, the touch panel 13 according to the present disclosure can detect the touch location in the plane direction and the pressing force.

((Manufacturing Method for Pressure-Sensitive Switch According to Present Disclosure))

A manufacturing method for the pressure-sensitive switch according to the first embodiment of the present disclosure will be described below. FIGS. 9A to 9E referred to here to explain the manufacturing method schematically illustrate successive steps of the manufacturing method for the pressure-sensitive switch according to the first embodiment of the present disclosure. Though not illustrated, a later-described manufacturing method for the pressure-sensitive switch according to the second embodiment of the present disclosure is basically similar to that for the pressure-sensitive switch according to the first embodiment of the present disclosure.

(Step of Preparing Support Substrate 2)

Figure 9A:
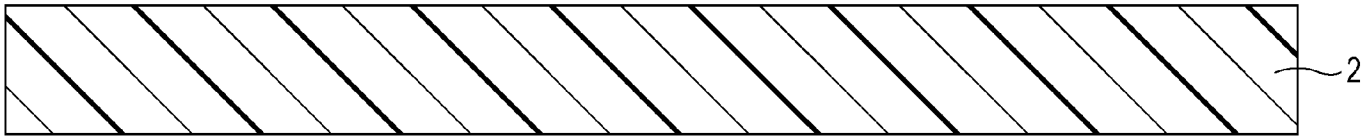
FIGS. 9A to 9E are schematic views illustrating successive steps of a manufacturing method for the pressure-sensitive switch according to the present disclosure.

First, the support substrate 2 is prepared as illustrated in FIG. 9A. The support substrate 2 has flexibility and is made of plastic, such as polyethylene terephthalate, polycarbonate, or polyimide.

(Step of Forming Elastic Components 7)

Figure 9B:
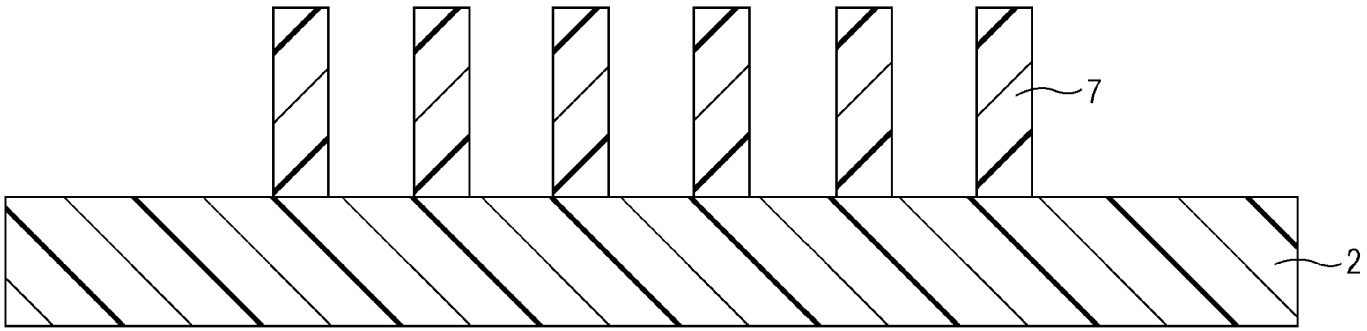

Next, as illustrated in FIG. 9B, a liquid polymer resin material is coated over the support substrate 2. The liquid polymer resin material may be made of, e.g., a urethane resin, a silicone based resin, or a styrene resin. Then, the liquid polymer resin material coated over the support substrate 2 is pressed by a mold having a rugged pattern and is hardened. Thus, the rugged pattern of the mold is transferred to the coated liquid polymer resin material, and the elastic components 7 each having a locally pillar shape (e.g., a columnar or conical structure) can be formed on the support substrate 2. The above-mentioned method of forming the elastic components 7 employs the nano imprint technique. The term "nano imprint technique" implies a technique of pressing a mold having a rugged pattern against a resin used as a material to be transferred, and transferring the rugged pattern formed in the mold in nano order to the resin. The nano imprint technique can form an array of solids having slopes, such as cones, in a fine pattern at a lower cost than that required in the known lithography technique. In the case using the nano imprint technique, shapes and heights of the elastic components 7 can be easily controlled by employing a mold that has a desired rugged pattern determined in advance. Projection cross-sectional shapes of the elastic components 7 can also be easily controlled by employing the nano imprint technique. Therefore, the change of the contact area between the electrode unit(s) 4 and the electrode layer 8 can be made more moderate. Thus, the change of the resistance value between the electrode unit(s) 4 and the electrode layer 8 can be moderated. It is hence possible to sense the pressing force applied through the pressing substrate 5 with high accuracy. As a matter of course, the elastic components 7 may be formed by photolitho-etching or the development and separation technique instead of the nano imprint technique. Also in the case using the photolitho-etching, the plural elastic components 7 having the desired shapes, heights, projection cross-sectional shapes, etc. can be formed on the support substrate 2 by controlling the concentration and the flow rate of an etching liquid.

(Step of Forming Electrode Layer 8)

Figure 9C:
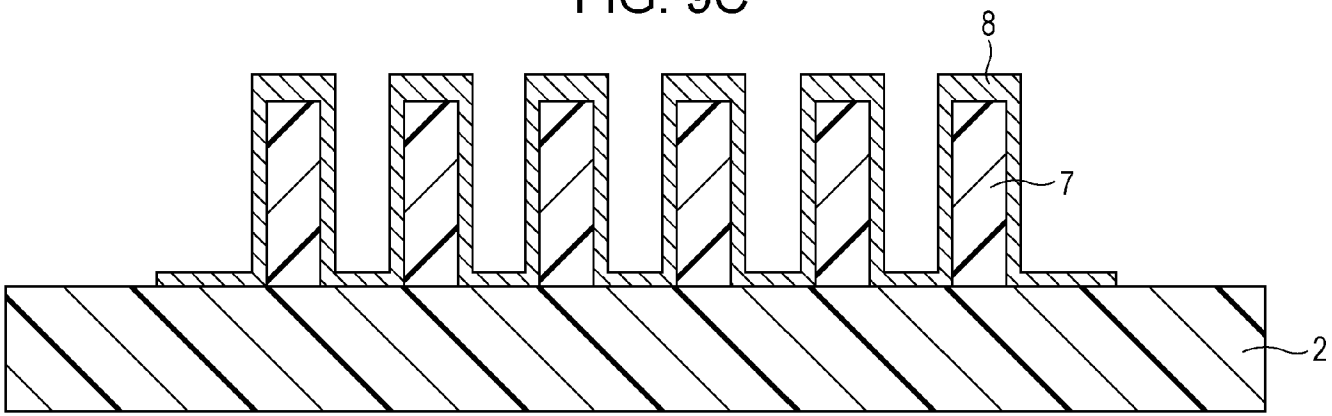

Next, as illustrated in FIG. 9C, ink containing conductive particles dispersed therein is continuously coated without blanks over the projecting outline surfaces of the elastic components 7 that are provided on the support substrate 2 in spaced relation from each other at intervals, and over the surface of the support substrate 2 exposed between the individual elastic components 7. With this step, the electrode layer 8 having the continuous form can be formed eventually. In practice, the ink containing conductive particles dispersed therein implies ink in which conductive particles made of a material selected from a group including Au, Ag, Cu, C, ZnO, $In_2O_3$, etc. are dispersed. When coating the ink containing the conductive particles dispersed therein, a paste prepared by mixing and dispersing a binder resin into an organic solvent is preferably coated by printing. The binder resin functions as a binder to bind the conductive particles to one another, thus increasing durability of the electrode layer 8 eventually. By properly adjusting the viscosity of the coated ink, the electrode layer 8 can be uniformly formed without being affected by the shapes, the sizes, the materials, etc. of the support substrate 2 and the elastic components 7. The binder resin may be, for example, an ethylcellulose resin or an acrylic resin. The organic solvent may be, for example, terpineol or butyl carbitol acetate.

It is also preferable to form the electrode layer 8 having the continuous form by electroless plating over the projecting outline surfaces of the elastic components 7 that are provided on the support substrate 2 in spaced relation from each other at intervals, and over the surface of the support substrate 2 exposed between the individual elastic components 7. The term "electroless plating" implies a technique of forming a metal thin film, i.e., the electrode layer 8, with electrons supplied through an oxidation reaction of a reducing agent, which is added to an aqueous solution, without employing an external DC power supply. In the electroless plating, no current flows through a bath unlike electroplating. Therefore, plating can be performed in a state where a catalyst promoting the oxidation reaction of the reducing agent is applied to not only a conductive material, but also to a nonconductive material, such as the plastic constituting the support substrate 2. For example, Pd is used as the catalysis, though not being particularly limited to Pd. By immersing the support substrate 2, including the catalyst, into a plating solution that contains a desired metal element, a metal film is formed on the catalyst and the electrode layer 8 is obtained. The electrode layer 8 having the desired durability can be formed by adjusting the composition ratio, concentration, temperature, etc. of the plating solution. By forming the electrode layer 8 as described, even when the pressing substrate 5 is pressed repeatedly, shear forces are less apt to act between each elastic component 7 and the electrode layer 8. Thus, deterioration of the elastic component 7 can be suppressed. Methods for forming the electrode layer 8 are not limited to the above-described methods of employing the ink containing the conductive particles dispersed therein, and of utilizing the electroless plating. Instead of those methods, the sol-gel method may be used to form the electrode layer 8. The term "sol-gel method" implies a liquid-phase synthesis method of obtaining a polymer solid by utilizing a hydrolytic polycondensation reaction of a metal alkoxide compound or metal salt. Alternatively, the electrode layer 8 may be formed by sputtering or vapor deposition.

As described above, the conductive structure 3 can be formed as an integral structure of the plural elastic components 7 and the electrode layer 8.

(Step of Forming Spacer 6)

Figure 9D:
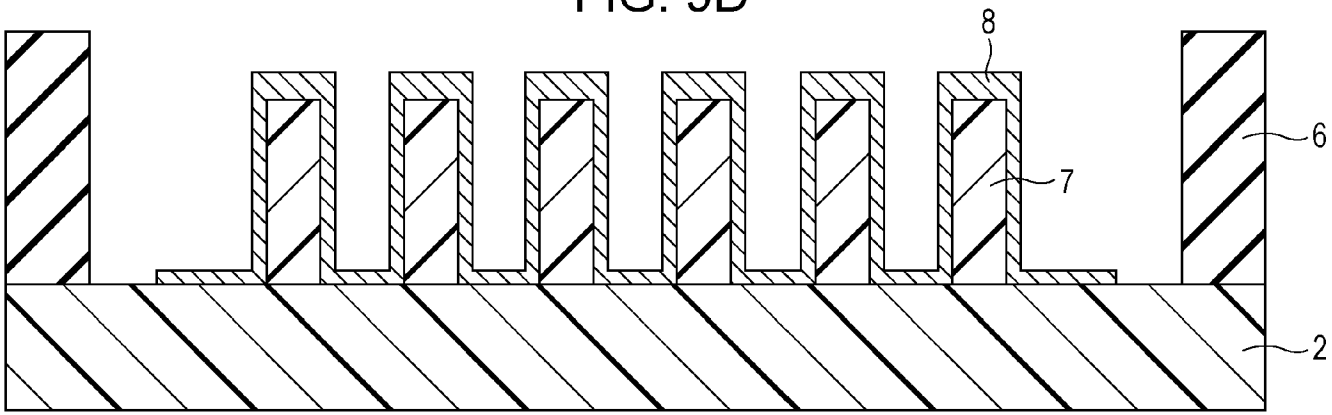

Next, as illustrated in FIG. 9D, the spacer 6 is formed on a peripheral edge of the support substrate 2 by employing insulating resin, such as a polyester resin or an epoxy resin.

(Step of Disposing Pressing Substrate 5)

Next, the plural electrode units 4 are provided in spaced relation from each other at intervals on the pressing substrate 5 that is made of, e.g., plastic having flexibility. Examples of the plastic include polyethylene terephthalate, polycarbonate, and polyimide. The pressing substrate 5 including the plural electrode units 4 is then disposed on the spacer 6 such that the electrode units 4 are positioned to face the elastic components 7. The electrode units 4 are also preferably formed by coating, over the pressing substrate 5, the ink containing conductive particles dispersed therein. In another example, the electrode units 4 are preferably formed by electroless plating. As an alternative, the electrode units 4 may be formed by the sol-gel method.

Figure 9E:
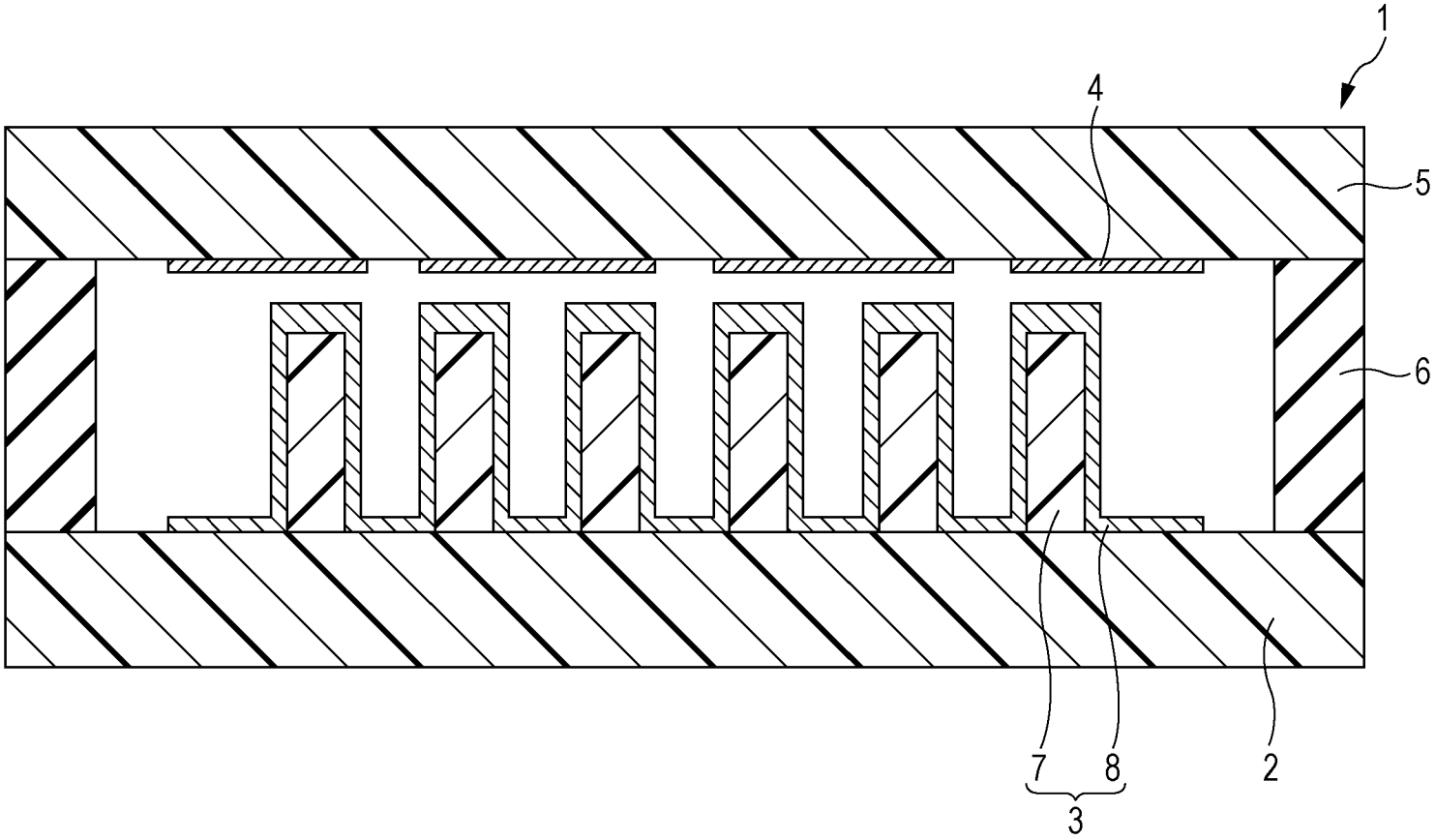

Through the above-described steps, as illustrated in FIG. 9E, the pressure-sensitive switch according to the first embodiment of the present disclosure can be manufactured.

A manufacturing method for the pressure-sensitive switch according to the second embodiment of the present disclosure will be described below. Similar points to those in the manufacturing method for the pressure-sensitive switch according to the first embodiment of the present disclosure are described in a simplified fashion.

(Step of Preparing Support Substrate 2)

First, the support substrate 2 is prepared. The support substrate 2 has flexibility and is made of plastic, such as polyethylene terephthalate, polycarbonate, or polyimide.

(Step of Forming Elastic Component 9)

Next, a liquid polymer resin material made of, e.g., a urethane resin, a silicone based resin, or a styrene resin is coated over the support substrate 2. The liquid polymer resin material coated over the support substrate 2 is then pressed by a mold having a rugged pattern and is hardened. As a result, the rugged pattern of the mold is transferred to the coated liquid polymer resin material, and the elastic component 9 is formed in continuation with the support substrate 2. Thus, the elastic component 9 can be formed in a state extending continuously from the support substrate 2. The elastic component 9 is preferably formed by employing the nano imprint technique. Instead of the nano imprint technique, the elastic component 9 may be formed by photolitho-etching or the development and separation technique.

(Step of Forming Electrode Layer 10)

Next, ink containing conductive particles dispersed therein is continuously coated without blanks over the projecting outline surface of the elastic component 9 that is provided on the support substrate 2 to protrude in the continuous form, and over the surface of the support substrate 2 exposed through the elastic component 9. With this step, the electrode layer 10 having a uniform thickness can be formed eventually. Alternatively, the electrode layer 10 may be formed by, e.g., electroless plating, the sol-gel method, sputtering, or vapor deposition. In such a manner, the conductive structure 3 can be formed as an integral structure of the elastic component 9 and the electrode layer 10.

(Step of Forming Spacer 6)

Next, the spacer 6 is formed on a peripheral edge of the support substrate 2.

(Step of Disposing Pressing Substrate 5)

Next, the electrode unit(s) is provided on the pressing substrate 5 that is made of, e.g., plastic having flexibility. The pressing substrate 5 including the electrode unit is then disposed on the spacer 6 such that the electrode unit is positioned to face the elastic component 9. The electrode unit is also preferably formed by coating, over the pressing substrate 5, the ink containing conductive particles dispersed therein. Alternatively, the electrode unit may be formed by electroless plating or the sol-gel method.

Through the above-described steps, the pressure-sensitive switch according to the second embodiment of the present disclosure can be manufactured.

((Manufacturing Method for Touch Panel Including Pressure-Sensitive Switch According to Present Disclosure))

A manufacturing method for the touch panel 13 including the pressure-sensitive switch 1 according to the present disclosure will be described below.

(Step of Forming Sensor 14 Detecting Only Touch Location in Plane Direction)

First, the above-described structure including the substrate 15 and the transparent conductive film 16 disposed on the substrate 15 is formed. Then, a composite structure is formed by stacking two those structures successively one above the other in the pressing direction. As a result, the sensor 14 for detecting only the touch location in the plane direction can be formed. The touch location in the plane direction is detected by the electrostatic capacitive method, for example.

(Step of Disposing Cover Film 17)

Next, the cover film 17 is disposed on the sensor 14 that detects only the touch location in the plane direction.

(Step of Disposing Pressure-Sensitive Switch According to Present Disclosure)

Next, the pressure-sensitive switch according to the present disclosure, which has been obtained with the manufacturing method for the pressure-sensitive switch according to the present disclosure, is disposed on the cover film 17.

Through the above-described steps, the touch panel 13 including the pressure-sensitive switch 1 according to the present disclosure can be manufactured which includes the sensor 14 for detecting only the touch location in the plane direction, and the pressure-sensitive switch 1 disposed on the sensor 14 with the cover film 17 interposed between them.

While the pressure-sensitive switch 1 according to the present disclosure, the manufacturing method for the pressure-sensitive switch 1, the touch panel 13 including the pressure-sensitive switch 1, and the manufacturing method for the touch panel 13 have been described above, the present disclosure is not limited to the matters disclosed in the foregoing description, it is to be understood that various modifications can be made by those skilled in the art without departing from the scope of an invention specified in the attached Claims.

The present disclosure can be embodied as follows.

A pressure-sensitive switch according to one aspect of the present disclosure includes a support substrate, a conductive structure provided on the support substrate, and a pressing substrate, and an electrode unit disposed to face the support substrate with the conductive structure interposed therebetween, wherein the conductive structure includes one or more elastic components extending to protrude from the support substrate toward the electrode unit, and an electrode layer covering the elastic component.

With the pressure-sensitive switch according to the one aspect of the present disclosure, since the elastic component having a regular shape extends to protrude from the support substrate, the shape of the elastic component can be uniformly deformed when a pressing substrate is pressed. Therefore, when a pressing force applied through the pressing substrate is increased, a contact area between the electrode layer covering the elastic component and the electrode unit can be uniformly increased. As a result, variations in change of a resistance value between the electrode unit and the electrode layer can be reduced, and the applied pressure can be sensed with high accuracy. Furthermore, with the present disclosure, since the elastic component extends to protrude from the support substrate, deterioration of the elastic component can be suppressed even when the pressing substrate is pressed repeatedly. As a result, reduction in sensitivity of the pressure-sensitive switch can be suppressed.

In the pressure-sensitive switch according to the one aspect, for example, each of the elastic components may extend to protrude from the support substrate substantially perpendicularly toward the electrode unit.

In the pressure-sensitive switch according to the one aspect, for example, each of the elastic components may have a columnar or conical shape.

In the pressure-sensitive switch according to the one aspect, for example, the conductive structure may include at least two elastic components, and the at least two elastic components may be spaced from each other.

In the pressure-sensitive switch according to the one aspect, for example, the at least two elastic components may have different heights.

In the pressure-sensitive switch according to the one aspect, for example, of the at least two elastic components, the higher elastic component may have a relatively larger projection cross-sectional area.

In the pressure-sensitive switch according to the one aspect, for example, the elastic component may extend in a continuous form from the support substrate.

In the pressure-sensitive switch according to the one aspect, for example, the elastic component may be provided in a grid-like manner on the support substrate.

In the pressure-sensitive switch according to the one aspect, for example, the electrode layer may be formed to continuously cover the elastic component extending to protrude from the support substrate and an exposed portion of the support substrate.

In the pressure-sensitive switch according to the one aspect, for example, the support substrate may have flexibility.

In the pressure-sensitive switch according to the one aspect, for example, the support substrate, the electrode layer, the elastic component, the electrode unit, and the pressing substrate may be transparent to light in a visible region.

According to another aspect of the present disclosure, there is provided a touch panel including a sensor that detects a touch location, and the pressure-sensitive switch according to the one aspect, the pressure-sensitive switch being disposed on the sensor.

According to still another aspect of the present disclosure, there is provided a manufacturing method for a pressure-sensitive switch, the manufacturing method including the steps of forming, on a support substrate, one or more elastic components each extending to protrude from the support substrate, providing a conductive structure by forming an electrode layer to continuously cover each of the elastic components and an exposed portion of the support substrate, and providing an electrode unit that is positioned to face the electrode layer.

In the manufacturing method for the pressure-sensitive switch according to the still another aspect of the present disclosure, for example, the elastic component may be formed by pressing a mold, which has a rugged pattern, against a polymer resin material coated over the support substrate, and by hardening the polymer resin material.

In the manufacturing method for the pressure-sensitive switch according to the still another aspect of the present disclosure, for example, the electrode layer may be formed by coating ink, which contains conductive particles dispersed therein, to continuously cover the elastic component extending to protrude from the support substrate and the exposed portion of the support substrate.

In the manufacturing method for the pressure-sensitive switch according to the still another aspect of the present disclosure, for example, the electrode layer may be formed by plating a film to continuously cover the elastic component extending to protrude from the support substrate and the exposed portion of the support substrate.

In the manufacturing method for the pressure-sensitive switch according to the still another aspect of the present disclosure, for example, the conductive structure may include at least two elastic components having different heights in the step of providing the conductive structure.

In the manufacturing method for the pressure-sensitive switch according to the still another aspect of the present disclosure, for example, of the at least two elastic components, the higher elastic component has a relatively larger projection cross-sectional area.

According to still another aspect of the present disclosure, there is provided a manufacturing method for a touch panel, the manufacturing method including the steps of forming a sensor that detects a touch location, and providing, on the sensor, the pressure-sensitive switch that is obtained by the above-described manufacturing method.

The pressure-sensitive switch 1 according to the present disclosure has the advantageous effects that the applied pressure can be sensed with high accuracy, and that deterioration of the elastic component 7 or 9 can be suppressed even when the pressing substrate 5 is pressed repeatedly.

Therefore, the pressure-sensitive switch 1 according to the present disclosure can be effectively applied to touch panels in, e.g., smartphones and car navigators. Thus, users can employ the touch panels with higher convenience than in the past.

What is claimed is:

1. A pressure-sensitive switch comprising:

a first substrate;

a conductive structure provided on the first substrate;

a second substrate;

and an electrode unit disposed to face the first substrate with the conductive structure located therebetween, wherein the conductive structure includes at least two elastic components extending to protrude from the first substrate toward the electrode unit, and an electrode layer covering the at least two elastic components, and the at least two elastic components are spaced from each other and have different heights.

2. The pressure-sensitive switch according to claim 1, wherein each of the at least two elastic components extends to protrude from the first substrate substantially perpendicularly toward the electrode unit.

3. The pressure-sensitive switch according to claim 1, wherein each of the at least two elastic components has a columnar or conical shape.

4. The pressure-sensitive switch according to claim 1, wherein, of the at least two elastic components, the higher elastic component has a relatively larger projection cross-sectional area.

5. The pressure-sensitive switch according to claim 1, wherein the at least two elastic components extend in a continuous form from the first substrate.

6. The pressure-sensitive switch according to claim 5, wherein the at least two elastic components are provided in a grid-like manner on the first substrate.

7. The pressure-sensitive switch according to claim 1, wherein the electrode layer is formed to continuously cover the at least two elastic components extending to protrude from the first substrate and an exposed portion of the first substrate.

8. The pressure-sensitive switch according to claim 1, wherein the first substrate has flexibility.

9. The pressure-sensitive switch according to claim 1, wherein the first substrate, the electrode layer, the at least two elastic components, the electrode unit, and the second substrate are transparent to light in a visible region.

10. A touch panel comprising:

a sensor that detects a touch location; and a pressure-sensitive switch disposed on the sensor, the pressure-sensitive switch comprising:

a first substrate;

a conductive structure provided on the first substrate;

a second substrate;

and an electrode unit disposed to face the first substrate with the conductive structure located therebetween, wherein the conductive structure includes at least two elastic components extending to protrude from the first substrate toward the electrode unit, and an electrode layer covering the at least two elastic components, and the at least two elastic components are spaced from each other and have different heights.

11. A manufacturing method for a pressure-sensitive switch, the manufacturing method comprising the steps of:

forming, on a first substrate, at least two elastic components each extending to protrude from the first substrate;

providing a conductive structure by forming an electrode layer to continuously cover each of the at least two elastic components and an exposed portion of the first substrate; and providing an electrode unit that is positioned to face the electrode layer, wherein the at least two elastic components have different heights in the step of providing the conductive structure.

12. The manufacturing method for the pressure-sensitive switch according to claim 11, wherein the at least two elastic components are formed by pressing a mold, which has a rugged pattern, against a polymer resin material coated over the first substrate, and by hardening the polymer resin material.

13. The manufacturing method for the pressure-sensitive switch according to claim 11, wherein the electrode layer is formed by coating ink, which contains conductive particles dispersed therein, to continuously cover the at least two elastic components extending to protrude from the first substrate and the exposed portion of the first substrate.

14. The manufacturing method for the pressure-sensitive switch according to claim 11, wherein the electrode layer is formed by plating a film to continuously cover the at least two elastic components extending to protrude from the first substrate and the exposed portion of the first substrate.

15. The manufacturing method for the pressure-sensitive switch according to claim 11, wherein, of the at least two elastic components, the higher elastic component has a relatively larger projection cross-sectional area.

16. A manufacturing method for a touch panel, the manufacturing method comprising the steps of:

forming a sensor that detects a touch location; and providing, on the sensor, the pressure-sensitive switch that is obtained by the manufacturing method according to claim 11.

* * * * *